US011613836B2

(12) United States Patent
Beatty

(10) Patent No.: US 11,613,836 B2
(45) Date of Patent: Mar. 28, 2023

(54) LIGHTWEIGHT QUAD MOUNT TUFTING MACHINE SHIFTABLE NEEDLE BAR ASSEMBLY

(71) Applicant: Tuftco Corporation, Chattanooga, TN (US)

(72) Inventor: Paul Beatty, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 372 days.

(21) Appl. No.: 16/712,926

(22) Filed: Dec. 12, 2019

(65) Prior Publication Data

US 2020/0190717 A1 Jun. 18, 2020

Related U.S. Application Data

(60) Provisional application No. 62/778,727, filed on Dec. 12, 2018.

(51) Int. Cl.
*D05C 15/30* (2006.01)
*D05C 15/18* (2006.01)

(52) U.S. Cl.
CPC ..... *D05C 15/30* (2013.01); *D05C 15/18* (2013.01)

(58) Field of Classification Search
CPC ..... D05C 15/20; D05C 15/16; D05C 15/18; D05C 15/22; D05C 15/24; D05C 15/30
See application file for complete search history.

(56) References Cited

U.S. PATENT DOCUMENTS 2,966,866 A * 1/1961 Card ..... D05C 15/18 226/9
3,026,830 A * 3/1962 Bryant ..... D05C 15/30 112/98
3,301,205 A * 1/1967 Card ..... D05C 15/28 112/80.31
3,847,098 A * 11/1974 Hammel, Jr. ..... D05C 15/32 112/80.73
4,173,192 A * 11/1979 Schmidt ..... G05B 19/351 112/80.24
4,366,761 A * 1/1983 Card ..... D05C 15/30 112/80.23
4,399,758 A * 8/1983 Bagnall ..... D05C 15/30 112/80.41
4,465,001 A * 8/1984 Ingram ..... D05C 15/30 112/80.41
4,501,212 A * 2/1985 Slattery ..... D05C 15/26 112/80.41
4,662,291 A * 5/1987 Bardsley ..... D05C 15/20 112/80.41
4,815,402 A * 3/1989 Price ..... D05C 15/12 112/80.44
5,193,472 A * 3/1993 Crossley ..... D05C 15/12 112/80.51
5,320,053 A * 6/1994 Beasley ..... B30B 1/263 74/570.1
5,706,745 A * 1/1998 Neely ..... D05C 15/22 112/80.55

(Continued)

*Primary Examiner* — Danny Worrell
(74) *Attorney, Agent, or Firm* — Miller & Martin PLLC

(57) ABSTRACT

A lightweight needlebar drive is provided that vertically reciprocates a needlebar by driven feet mounted to the lower ends of pushrods, where the feet are laterally positionable by virtue of a plurality of stub shafts passing through and received in bearings on adjacent brackets connected to the needlebar.

20 Claims, 10 Drawing Sheets

(56) References Cited

U.S. PATENT DOCUMENTS

| | | | | |
|---|---|---|---|---|
| 6,263,811 | B1 * | 7/2001 | Crossley | D05C 15/20 112/80.4 |
| 6,735,837 | B2 * | 5/2004 | Pum | D04H 18/02 28/107 |
| 7,373,705 | B2 * | 5/2008 | Jean | D04H 18/02 28/113 |
| 7,578,249 | B2 * | 8/2009 | Morgante | D05B 69/32 112/80.01 |
| 9,260,810 | B2 * | 2/2016 | Neely | D05C 15/30 |
| 9,290,874 | B2 * | 3/2016 | Mathews | D05C 15/28 |
| 9,657,419 | B2 * | 5/2017 | Hall | D05C 11/00 |
| 9,708,739 | B2 * | 7/2017 | Hall | D05C 15/36 |
| 10,011,932 | B2 * | 7/2018 | Neely | D05C 15/20 |
| 11,193,225 | B2 * | 12/2021 | Hall | D05C 15/22 |

* cited by examiner

LIGHTWEIGHT QUAD MOUNT TUFTING MACHINE SHIFTABLE NEEDLE BAR ASSEMBLY

The present application claims priority to U.S. Patent Application 62/778,727 filed Dec. 12, 2018.

BACKGROUND OF THE INVENTION

The invention relates to a novel sliding needle bar design and lightweight drive assembly useful in high speed tufting.

In the production of tufted fabrics, a plurality of spaced yarn carrying needles extend transversely across the machine and are reciprocated to penetrate and insert loops of yarn into a backing material fed longitudinally beneath the needles. The loops of yarn are seized or cut by gauge parts to create a cut pile, loop pile or cut loop pile surface. Several techniques have been developed to provide patterning in the resulting tufted fabrics including the use of yarn feeds that may control the feeding of single yarns on each penetration, precise control of the backing fabric, and lateral displacement of the backing material relative to the needles.

Almost every aspect of tufting has evolved over time to provide better and more diverse fabric-making capabilities, including yarn feed apparatus, lateral shifting mechanisms, gauge parts, and main yarn drives. For instance, in U.S. Pat. Nos. 4,366,761 and 5,193,472 depicting dual sliding or shiftable needle bar tufting mechanisms, rocking motion was provided by a rocker arm linkage to a main driveshaft to cause pushrods to reciprocally move a needle bar upward and downward to cause needles to penetrate the backing fabric. In some ways, this was an effective design because the main driveshaft did not require removal for routine adjustments, with adjustment to the needle stroke affected by working with readily accessible rocker arms. However, the use of rocker shafts imparted significant vibration to the tufting machines. More efficient designs such as using split cams in U.S. Pat. No. 5,320,053 or belt drives in U.S. Pat. No. 5,706,745 were introduced to provide for less vibration at higher speeds, while still permitting adjustments without the necessity of removing the main drive shaft.

Similarly, yarn feeds developed from simple roll type patterning attachments as in U.S. Pat. No. 2,966,866, to various electromagnetic scroll-type arrangements as in U.S. Pat. No. 3,847,098, and ultimately various servo motor driven yarn feeds as in U.S. Pat. Nos. 6,439,141 and 6,834,611, that have the capability to control each single end of yarn in each penetration. Sliding needle bar apparatus also evolved from cam-driven lateral shifters as in U.S. Pat. Nos. 3,026,830 and 3,301,205, to hydraulic shifters as disclosed in U.S. Pat. No. 4,173,192, to various servo motor driven linear actuators as in U.S. Pat. No. 5,979,344.

In each case, the advances in tufting technology must satisfy certain levels of adjustability, service access, and precision. Once these minimum characteristics of usability are satisfied, advances providing improved patterning capabilities and durability are preferred. It is also desired that the tufting machines operate at relatively higher speeds without incurring undue expense for the equipment or its operation. By way of reference, sliding needle bar apparatus transversely driven by cams and vertically driven by rocker shaft type assemblies, might have operated at only 300 to 500 stitches per minute. With a hydraulic shifting mechanism and a high-speed yarn drive, the shifted stitch rates might reasonably be increased to 600 to 800 reciprocations per minute. With servo driven linear actuator shifting and further improved main drive operation, shifted stitch rates of even 1200 stitches per minute have been obtainable.

As stitch rates become greater and greater, the vibrations set up within tufting machines also tend to increase. To address part of this problem, counter-balancing shaker apparatus have been developed as described in U.S. Pat. No. 7,578,249 and deployed to excellent result. Even so, as unshifted tufting speeds approach 2000 stitches and shifted tufting speeds approach 1600 penetrations per minute, more effective machine operation can be achieved by further refining the structure and movement of the needle bar apparatus. The lateral forces imparted by transversely shifting a needle bar at stitch rates in the range of 1500 to 1600 stitches per inch may approach 15 g's. The forces acting upon the upward and downward reciprocation of the needles at 1500 to 2000 rpm may even exceed 60 g's. These G-forces are most easily countered when lighter weight needle apparatus is used.

To minimize both the physical stress and vibration inherent in such high-speed operation, it is desirable to reduce the weight of the transversely shifted and vertically reciprocated elements comprising the needle bar and related components. Interestingly, as weight is removed from rapidly moving elements, some of the reinforcing structures required for controlling high G-forces acting upon heavier weight may also be eliminated. Thus, the removal of weight from the vertically reciprocating needle bar, needles, and attached structures may contribute to the use of lighter weight vertically reciprocating pushrods. The lighter weight needle bar assembly may also lead to the removal of reinforcing structures previously deemed necessary to enable rapid transverse movement. Therefore, to further reduce harmonic vibrations and achieve faster tufting machine operation, it is desirable to design needle bar assemblies with reduced weight and in view of the lighter weight needle bar assembly to further reduce weight throughout the main drive and transverse shifting systems acting upon the needle bar.

DETAILED DESCRIPTION OF THE INVENTION

Figure 1A:
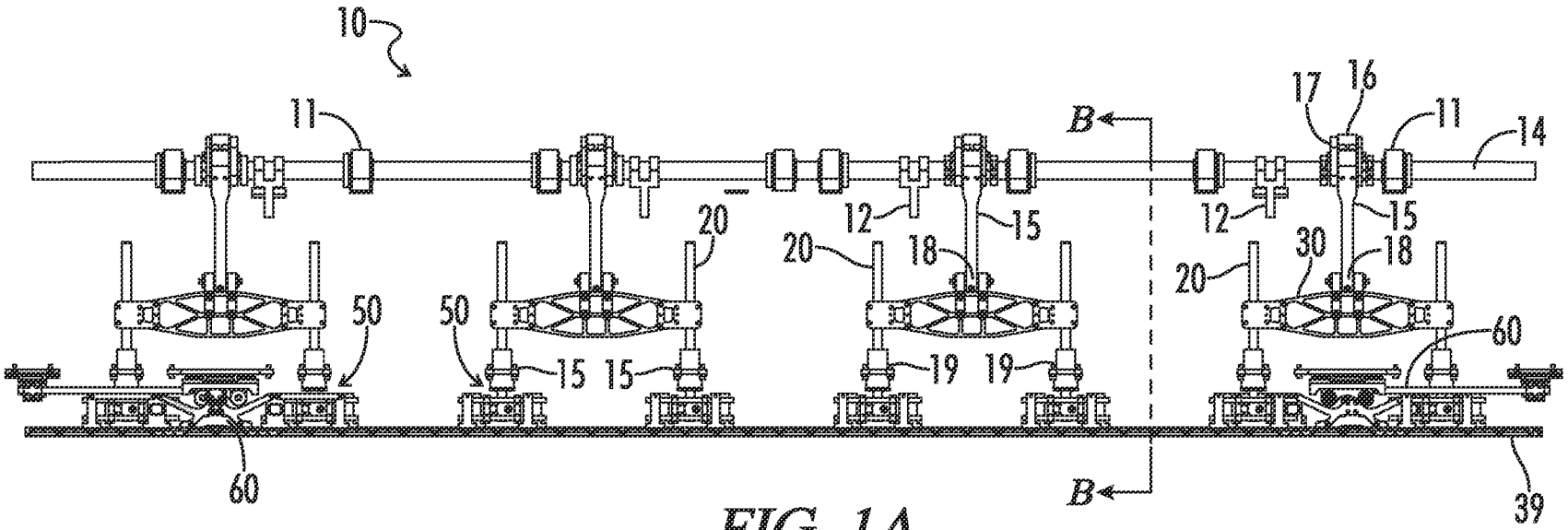
FIG. 1A illustrates a front plan view of a needle bar drive assembly in a tufting machine with split cam rotational drive.
Figure 2A:
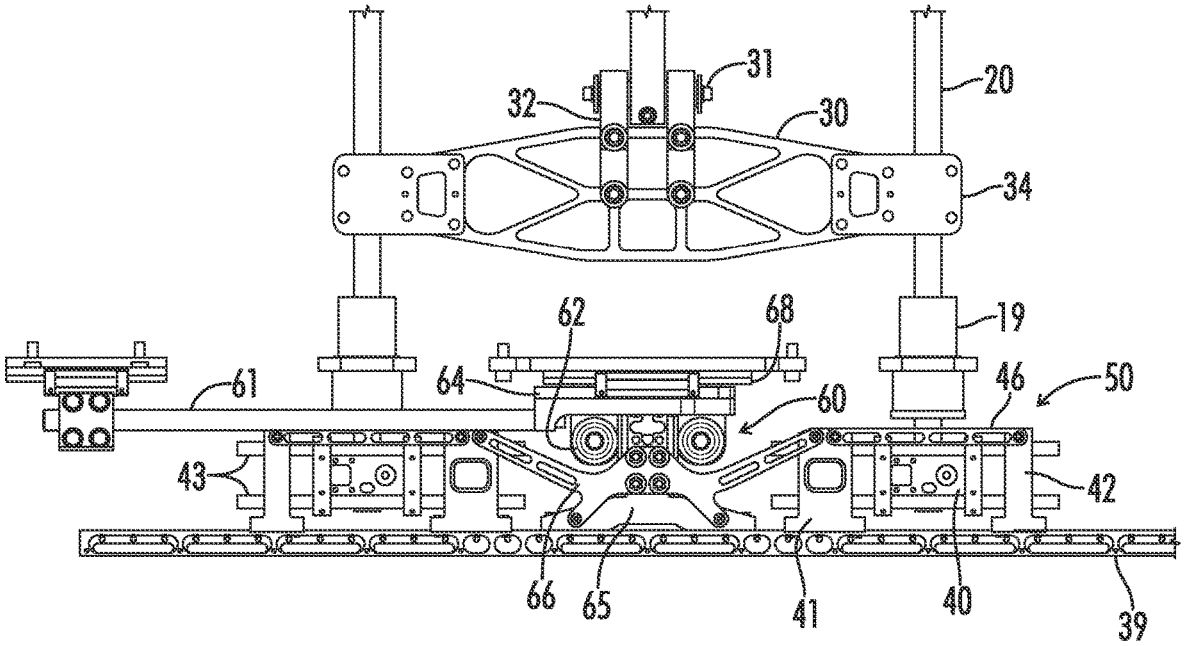
FIG. 2A is a front plan view of 1 needle drive assembly at the left of the tufting machine of FIG. 1A shown in its top dead center position.
Figure 2B:
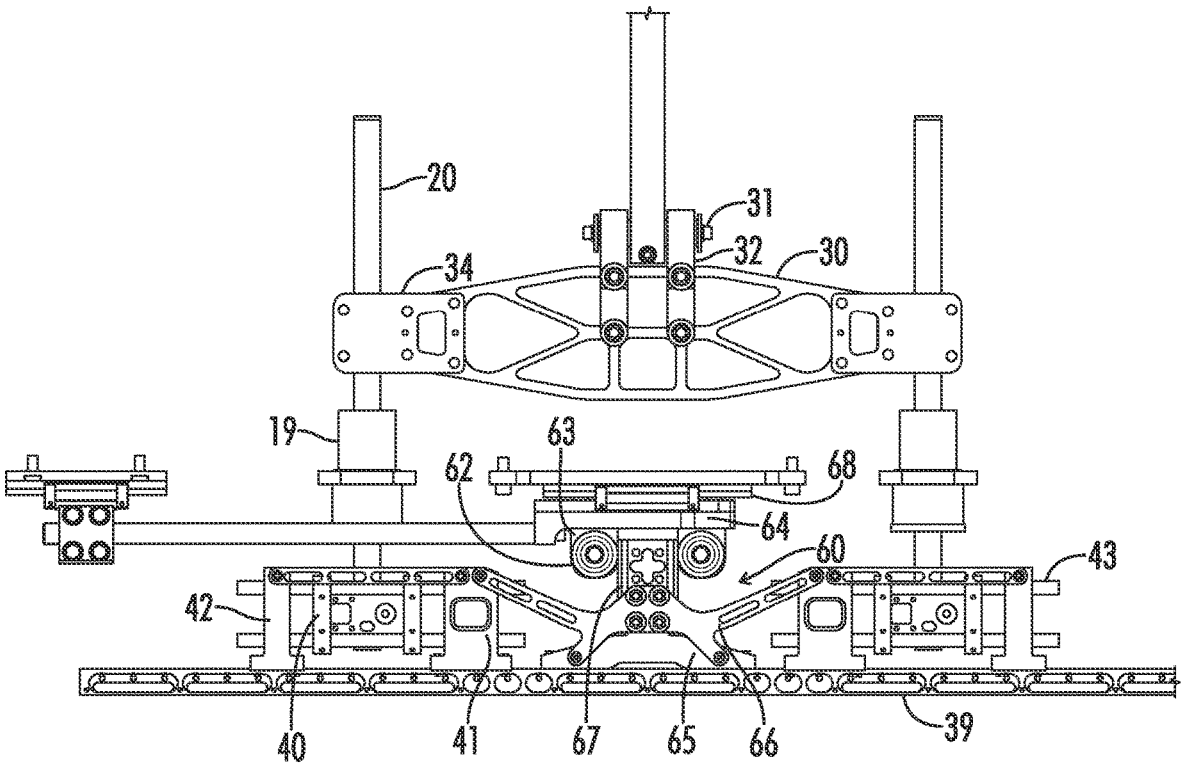
FIG. 2B is the portion of the needle drive assembly shown in FIG. 2A in its bottom dead center position.
Figure 2C:
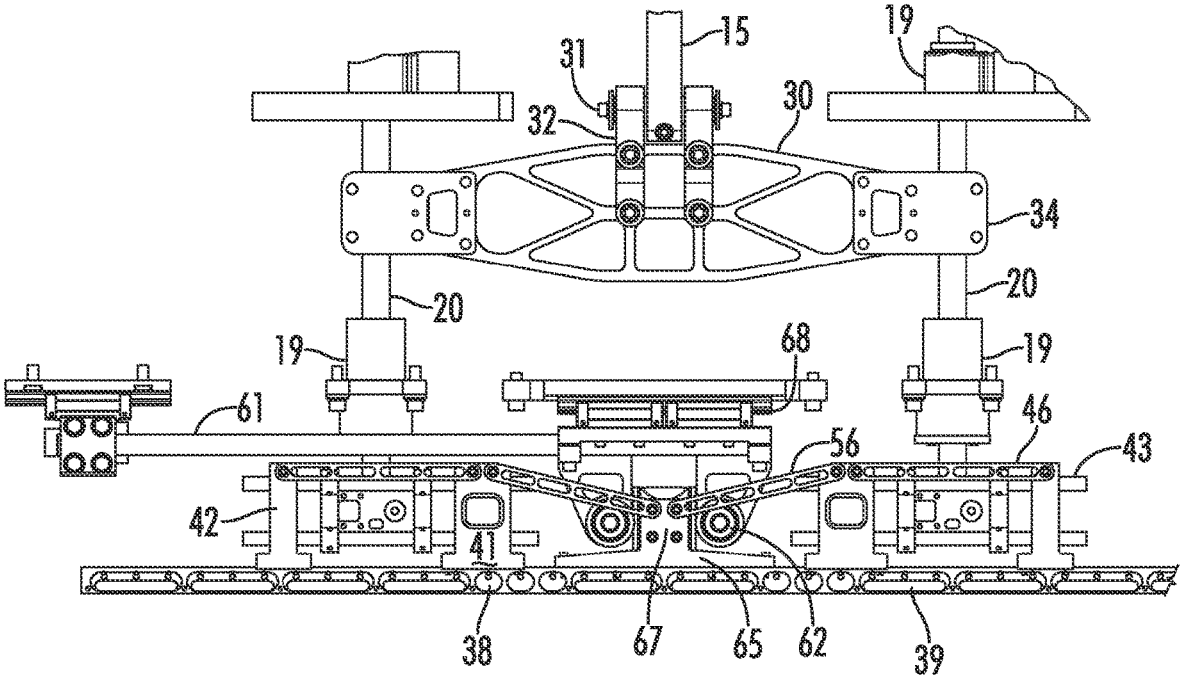
FIG. 2C is a front plan view of a needle drive assembly similar to that depicted in FIG. 2A, however with a more compact transverse drive.

Referring to FIG. 1A, the needle drive apparatus 10 of a tufting machine is illustrated. A power source is not shown, but is typically connected at each end to drive a main driveshaft 14. The driveshaft 14 passes through a plurality of supporting bearings 11, and has mounted upon it a number of eccentrics generally concealed within connecting rods 15 and their attached connecting rod caps 16. Adjacent counterweights 12 are mounted offset approximately 180° from the throw of the eccentrics to provide rotational balance to the driveshaft which may be driven at speeds in excess of 2000 revolutions per minutes. The connecting rods 15 have bolt attached caps 16 and are generally positioned on eccentrics and kept in position by adjustable eccentric endplates 17. The connecting rods 15 have lower wrist ends 18 that are connected by pins 31 permitting angular movement relative to brackets 32 attached to a push rod connector bridge 30. The push rod connector bridges 30 are joined to pairs of adjacent push rods 20 as shown in FIGS. 2A, 2B with push rod clamps 34. FIG. 2C shows an alternative structure for a sliding needlebar assembly but utilizing the same general connecting rod 15 and push rod 20 mechanism.

Figure 5:
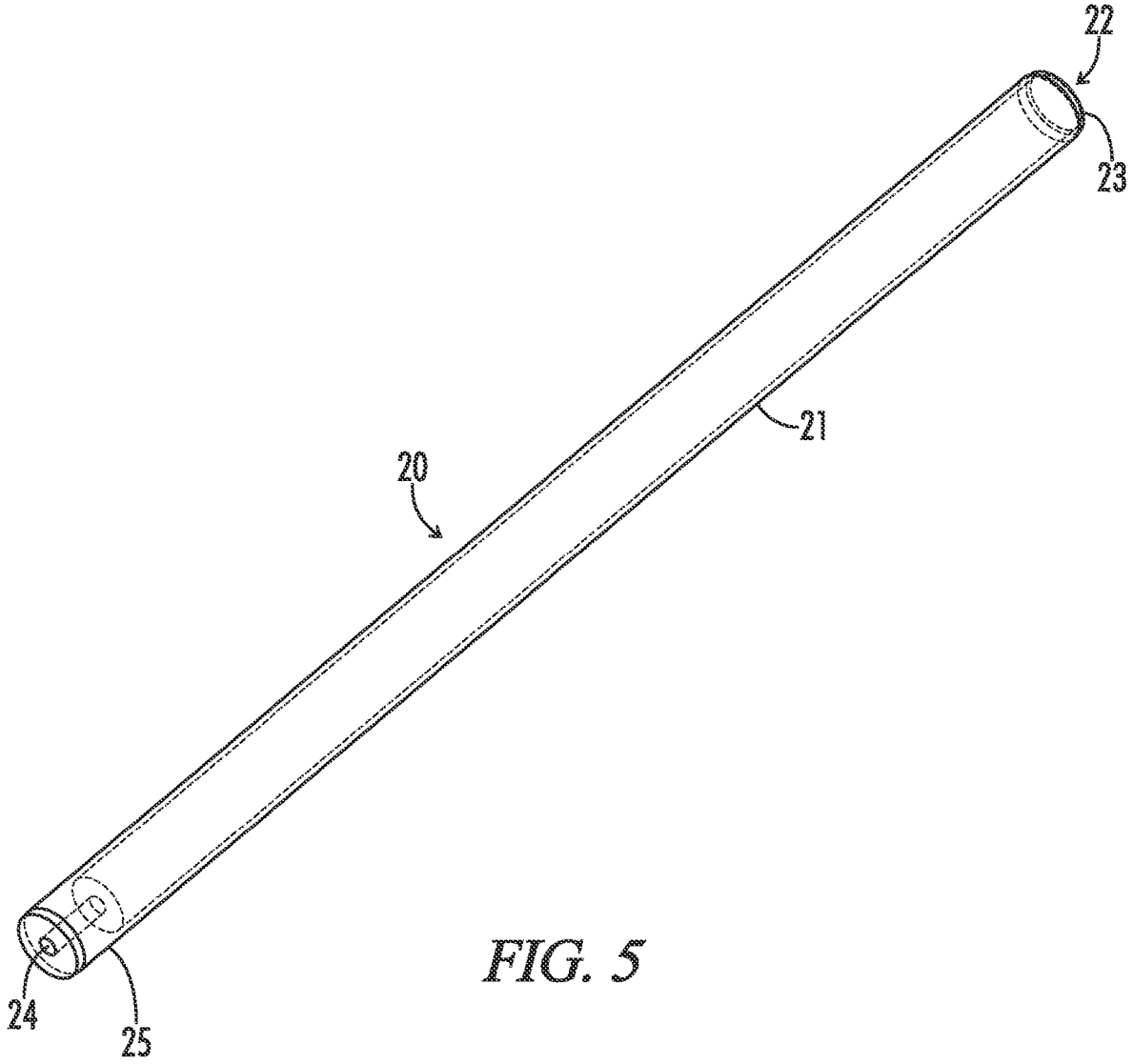
FIG. 5 is a perspective view of a push rod of FIG. 1A, 2A, 2B.
Figure 6:
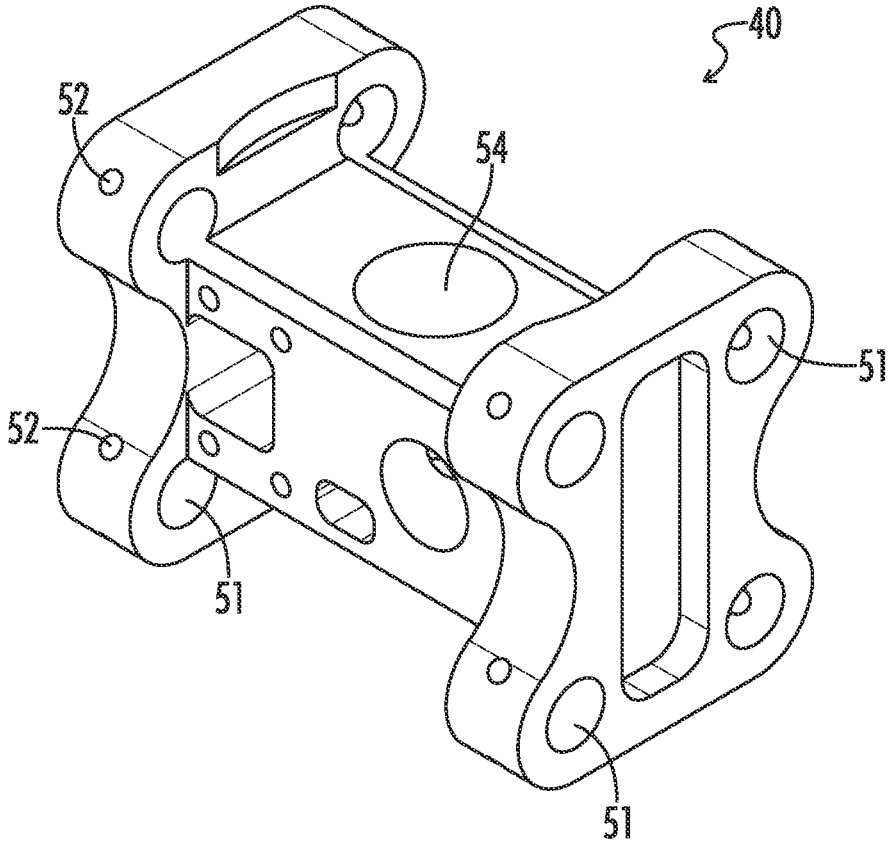
FIG. 6 is a perspective view of a foot as shown in FIGS. 2A, 2B and 3.

In operation, the offset of the cam within the upper end of the connecting rod 15 determines the throw of the connecting rod 15 which is imparted by its connection through bridges 30 to push rods 20 that reciprocally slide through upper and lower guide bearings 19 in a vertical direction. Push rod 20, as shown in isolation in FIG. 5, is preferably made with upper cylindrical bore 22, having a wall thickness 23 of only about 3/32 of an inch. Standard one-inch diameter push rods have previously been drilled with hollow inner diameters of about 5/8 of an inch and wall thicknesses of 3/16 of an inch. However, thinner walls were considered both too structurally compromised and too expensive to manufacture with straightforward gun drilling techniques. The lower end 25 of push rod 20 is left nearly solid with only a tap hole 24. The solid portion provides added strength for the clamping and driving forces that are imposed on this segment of the push rod 20 and allows threading of tap hole 24 for secure attachment to a foot 40 or similar assembly.

Because the volume of metal that is removed by drilling the cylindrical opening 22 in the top portion of push rod 20 is proportional to the cross-sectional area of the void ($\pi r^2$), a slight increase in the radius of the opening 22 produces a greater reduction in the volume of metal and corresponding weight that is removed. So for instance, in connection with a one inch diameter push rod, the prior art 5/8 inch inner diameter (5/16ths radius) removed less than 40% of the metal of the push rod. By increasing the inner diameter to 13/16 of an inch from 5/8 (or 10/16) inch, the effect is to remove 66% of the volume of metal comprising the solid rod. Thus, halving the wall thickness of push rods 20 around the cylindrical opening 22 provides a 70% increase in weight reduction by gun drilling.

Accordingly, material reduction of 50% or more by utilizing cylindrical walls 23 having a thickness of 0.1 inches or less can achieve substantial reduction in reciprocating weight when multiplied by eight or more push rods 20 that might be deployed in a typical tufting machine.

Figure 4:
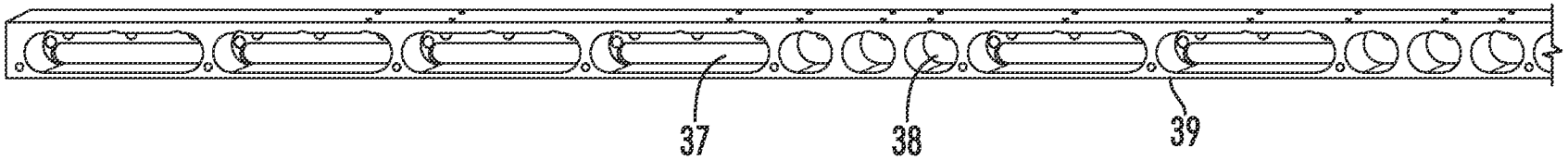
FIG. 4 is a perspective view of the left end of the needle bar of FIGS. 1A, 2A, 2B.

Turning then to FIG. 4, a section of a needle bar 39 is illustrated in isolation. Needle bars were originally made from machined steel which is strong, but heavy. Subsequently attempts have been made to utilize aluminum and titanium. Aluminum is lighter but generally slightly less rigid and has thermal expansion characteristics that differ from steel. Titanium is difficult to work with efficiently but strength and thermal characteristics are closer to those of steel. The illustrated section of needle bar 39 has larger and smaller areas of material removal. One shape of removed material is a nearly round drilled pocket 38 and the other is a substantially longer longitudinally milled pocket shape 37. These shapes are generally positioned for strength, with the smaller pockets 38 leaving more reinforcing wall material in areas subject to the greatest stress. Material is removed from both sides of the needle bar 39 in a similar fashion. However, a central web is generally left in place to provide additional rigidity particularly resisting against bending from vertical forces. The illustrated pockets are capable of removing approximately half of the metal that would be in a solid rectangular bar of similar dimensions.

Figure 1B:
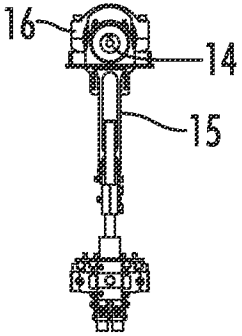
FIG. 1B is an end view of the tufting needle drive of FIG. 1A taken along B-B.
Figure 3A:
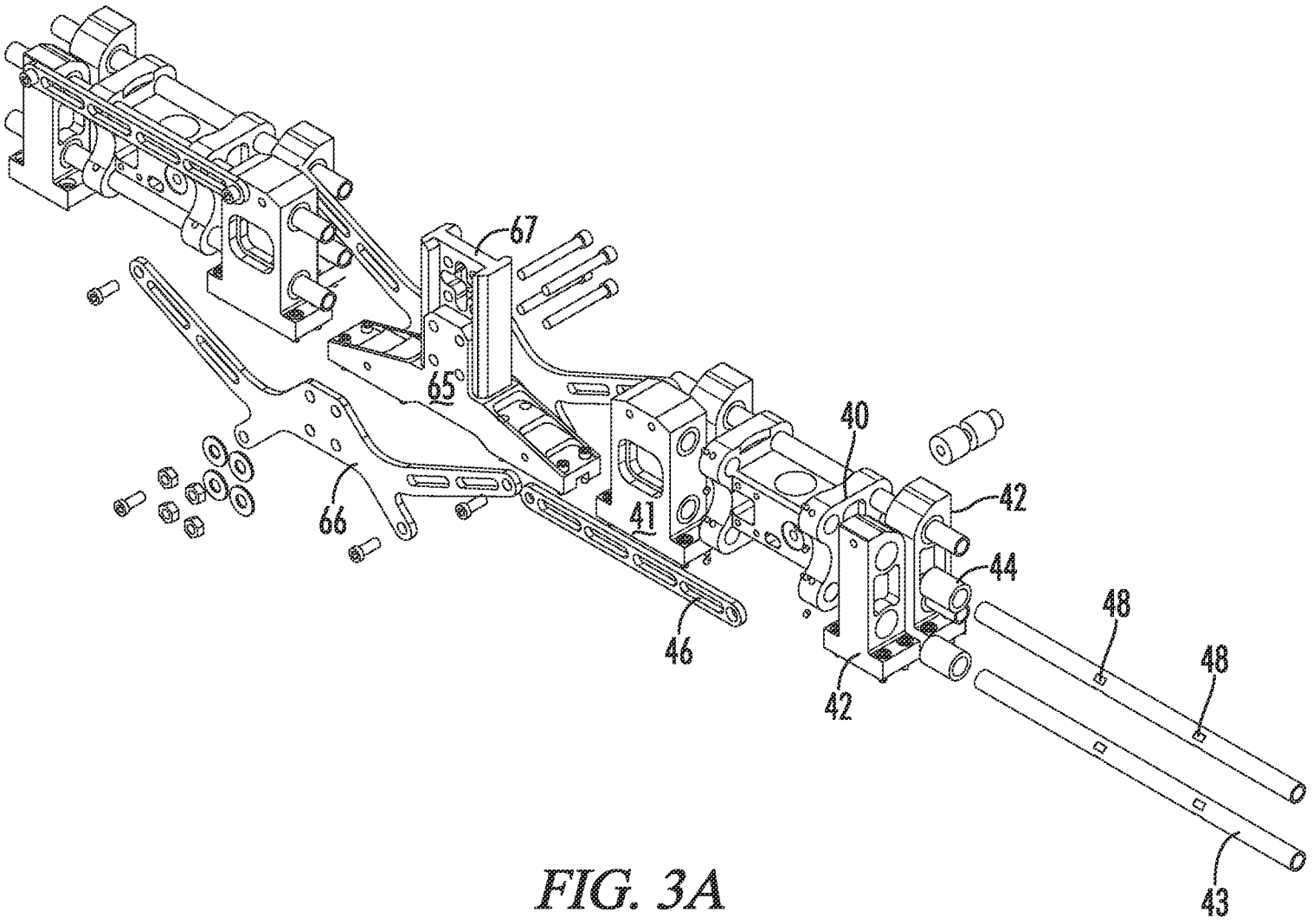
FIG. 3A is a partially exploded perspective view of the structure mounted on the needlebar of FIGS. 2A, 2B.
Figure 3B:
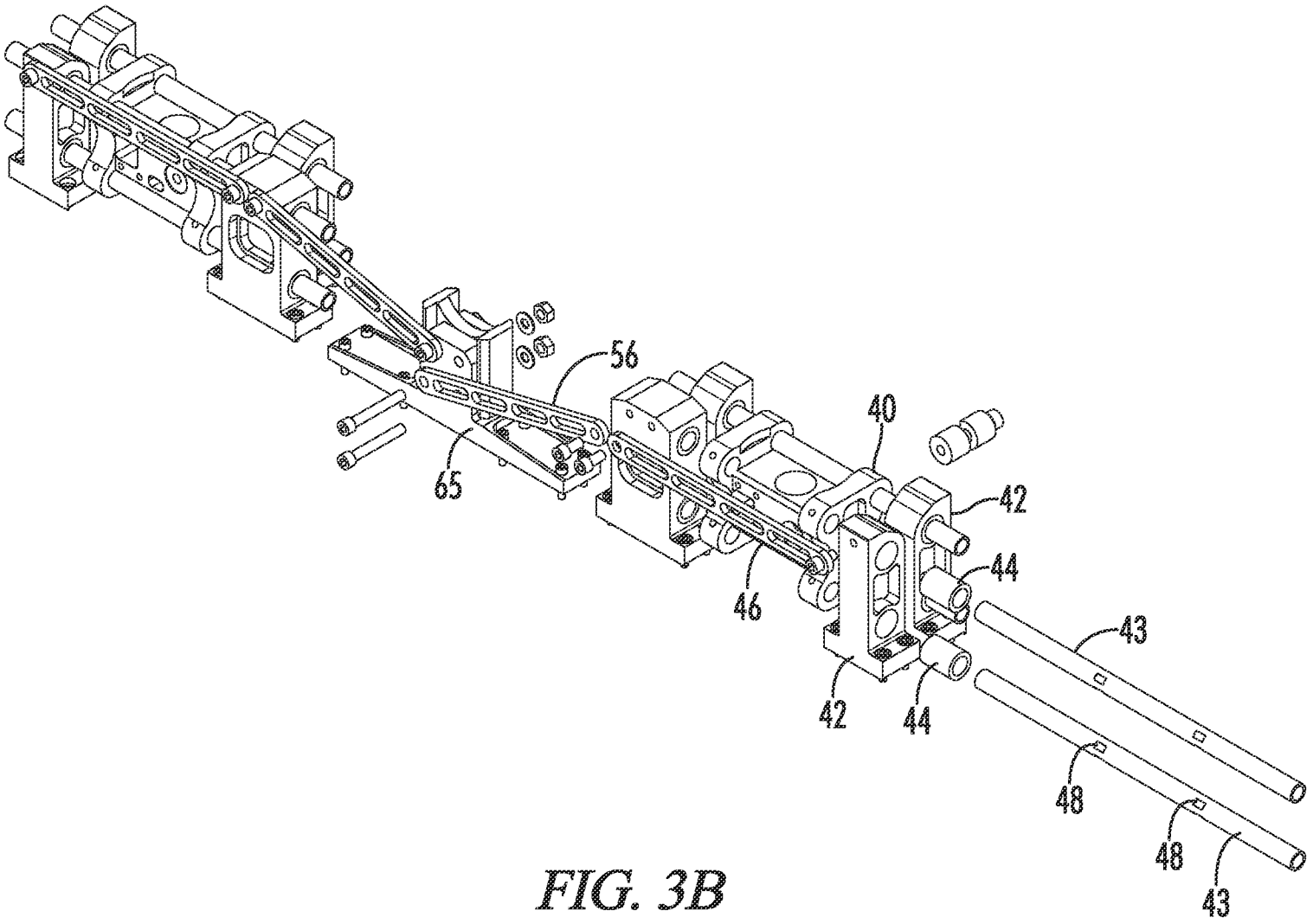
FIG. 3B is a partially explored perspective view of the structure mounted on the needlebar of FIG. 2C.

Turning then to the vertical drive blocks 50 and horizontal drive block bracket 60 illustrated in FIGS. 1-3, further advantages of the lightweight needle drive assembly can be observed. Each drive block 50 receives a foot 40 secured to the end 25 of a push rod 20. Because this is a sliding needle bar assembly, the foot 40 must allow the needle bar 39 to move transversely relative to the position of the foot 40. To accomplish this, each foot 40 is preferably designed with four transverse openings to receive hollow stub shafts 43. Preferably the hollow shafts 43 are securely fixed to the openings in the foot 40 but slidably received in linear bearings 44 mounted within openings of the support brackets 41 or standard brackets 42 attached to the needle bar 39. The four linear bearings 44 in each vertical drive block 50 provide a significant surface to distribute the vertical forces required to rapidly reciprocate needle bar 39. In addition, the brackets 41,42 can be removed and linear bearings 44 replaced in the event they should wear excessively over time. To best distribute the vertical forces, it is preferable to use shafts 43 with the largest reasonable diameter, and optimally with diameters over 0.5 inches.

Notably, the rigidity of the needlebar 39 is enhanced by a series of box like reinforcing structures. For instance, in FIGS. 2A and 2B, boxes are formed by the top cross-support or box link 46 in combination with support bracket 41 and standard bracket 42 and the segment of the needlebar 39 intermediate brackets 41,42. The standard and support brackets 41,42 are each secured at two longitudinal points along the length of the needlebar 39 so that they resist looseness and deflection. The box link 46 cannot be readily shortened or lengthened by longitudinal force so that any tendency of the segment of the needlebar 39 to bend between the support bracket 41 and standard bracket 42 is impeded. Similarly, the cross-web 66 that connects between support brackets 41 and drive block bracket base 65 effectively has a box link extending to either side and provides enhanced resistance to deformation for the segment of the needlebar 39 extending not only between adjacent support brackets 41, but also separately between each support bracket 41 and drive block bracket base 65.

In FIG. 2C, a more compact transverse drive mechanism is utilized and rather than the cross-web 66, separate box links 56 extend between support brackets 41 and the horizontal drive block bracket 60 or more precisely the lateral actuator block portion 67 of the drive block bracket base 65. These quadrilateral or box like constructions with one side being formed from a segment of the needlebar 39 are weight efficient for the degree of added rigidity provided to the needlebar. In both the constructions of FIGS. 2B and 2C, the horizontal drive block bracket 60 is positioned between the two vertical drive blocks 50 adjacent the edge of the needlebar.

The standard and support brackets 41,42 are fixed to the top of needle bar 39 that will have needles 70 protruding from its lower surface. Needles 70 shown in FIG. 7B also are lighter than conventional needles. Weight reduction is achieved by shortening the needle shafts, using needle blocks 71, and removing unnecessary material from the needle block structures.

Figure 7A:
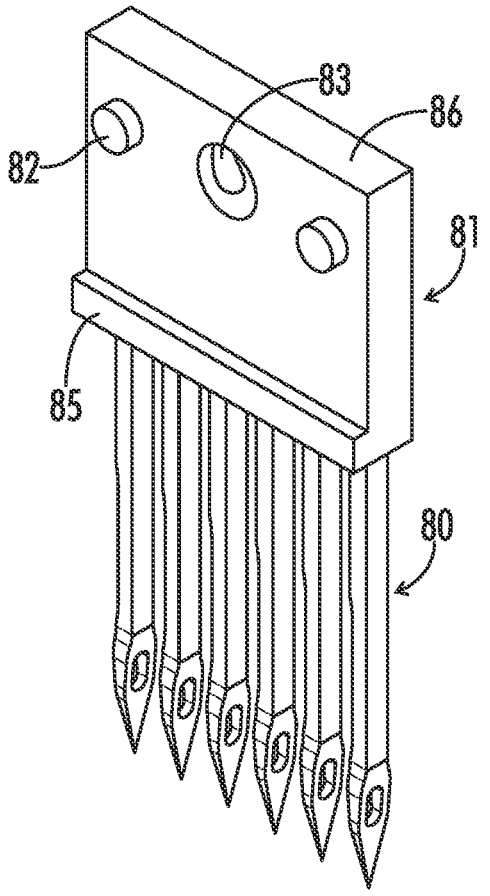
FIG. 7A is a plan view of a representative prior art needle block.
Figure 7B:
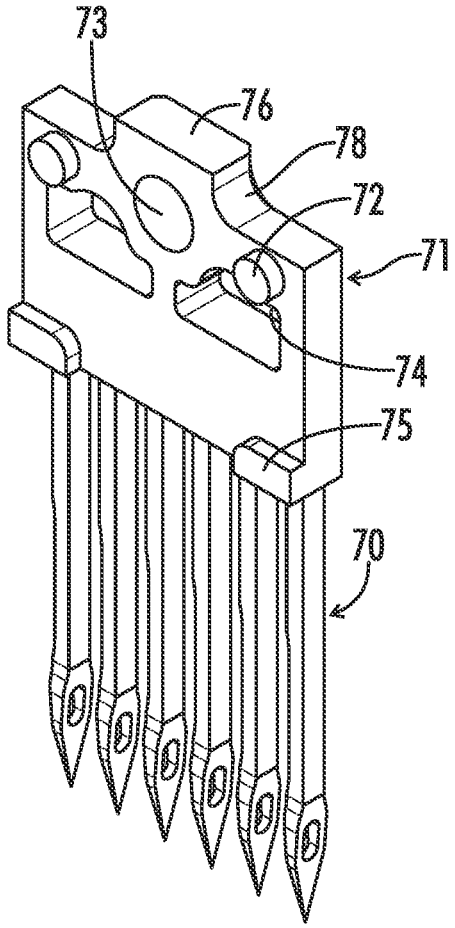
FIG. 7B is an illustration of a new lighter weight needle block design.

Prior art needleblocks 81 with needles 80 are shown in FIG. 7A. The needleblock 81 has a head with a top surface 86 and a lower positioning ledge 85 that together with posts 82 facilitate the positioning of the needleblock 81 in a precisely aligned location on needlebar 39 where it can be fastened with a screw through opening 83. The lighter weight needleblocks 71 adapted to be utilized in a high speed lightweight assembly achieve weight reduction not only through the slight shortening of shafts of needles 70 but also removal of unnecessary material in the shoulders 78 adjacent to the central top surface 76, the introduction of additional gussetry 74 removing material not required for the required strength of the needleblock 71, and even removal of a portion of the positioning ledge so that only side shelf 75 are utilized for positioning the needleblock 71. While the weight removed from a single needleblock is small, a tufting machine may have over 200 such needleblocks 71 mounted to needlebar 39 and the weight reduction in each needleblock is therefore multiplied many times.

Vertical drive blocks are distributed evenly across the tufting machine, typically with about two drive blocks per meter of tufting machine width. Transverse drive blocks are advantageously placed between the pair of vertical drive blocks adjacent the end of the needlebar.

Furthermore, in prior art shifting needle bar designs it was common to have at least two transverse drive blocks at each side of the tufting machine because the weight of the needle bar that was to be shifted transversely required greater reinforcement to drive the needle assembly effectively. As can be seen in FIGS. 2B and 3A, the transverse/horizontal drive mechanism includes a drive block bracket base 65 that is attached to the needle bar 39 and a cross web 66 of two box links connecting the drive block bracket base 65 to the support brackets 41 of the adjacent vertical drive blocks 50. Mounted securely within the transverse drive block 64 is an upward facing lateral actuator block 67 that is received between cam rollers 62 on cam roller bracket assembly 63 extending downward from transverse drive block 64. The transverse drive block 64 is driven by underhead drive rods 61 that are in communication with shifting mechanism that may be a cam, hydraulic, or most typically, linear actuator type device. The guide carriage 69 with transverse drive block 64 is steered by guide rail 68 fixed to the underside of the tufting machine head. Neither the guide rail 68 nor tufting machine head are moved and it is only the underhead drive rod 61 transverse drive block 64, and cam roller 62 in cam roller bracket assembly 63 that must be moved in a transverse direction to transversely shift the needle bar assembly.

Numerous alterations of the structure and techniques herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Numerous alterations of the structure and techniques herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

I claim:

1. A lightweight needlebar drive system with stub shafts supporting a plurality of foot pieces, a plurality of push rods having upper end and opposite lower ends with said lower ends connected to the plurality of foot pieces, the stub shafts allowing for slideable lateral movement of the foot pieces between adjacent brackets attached to a laterally oriented needlebar, wherein the pushrods have a cylindrical bore extending from the upper end to a position proximate the opposite lower end, leaving a wall thickness of the cylindrical bore portion of no more than about 0.09375 inches.

2. The lightweight needlebar drive system of claim 1 wherein each of the plurality of foot pieces is supported by a plurality of stub shafts with first ends and opposite second ends, the first and second ends of the stub shafts extending from either side of the foot pieces being received in linear bearings mounted in adjacent brackets connected to the needlebar.

3. A lightweight needlebar drive system with stub shafts supporting a plurality of foot pieces, a plurality of push rods having upper portions and opposite lower ends with said lower ends connected to the plurality of foot pieces, the stub shafts allowing for slideable lateral movement of the foot pieces between adjacent brackets attached to a laterally oriented needlebar, wherein adjacent brackets disposed on either side of a foot piece are connected by a box link to provide rigidity.

4. The lightweight needlebar drive system of claim 1 wherein needlebar is fabricated from titanium with titanium material removed in longitudinally milled pocket shapes on each side, while leaving a central web to provide rigidity.

5. The lightweight needlebar drive system of claim 1 wherein the needlebar carries a plurality needle blocks of the type having a top surface, and intermediate body with a positioning post and positioning ledge, and a lower surface with protruding needles, the weight of the needle blocks being reduced by at least one of removing material from shoulders of the top surface, removing a portion of the positioning ledge, or creating more than one opening in the intermediate body by removing material not required for the strength of the needle block.

6. The lightweight needlebar drive system of claim 1 wherein only a single drive block bracket is mounted to the needlebar in communication with a shifting mechanism that provides transverse forces to laterally position the needlebar.

7. A tufting machine, comprising:

backing feed rolls feeding a backing material through the tufting machine;

front and rear needlebars each having a series of needles spaced therealong, the needles being reciprocated, by the action of a plurality of push rods, into and out of the backing material;

a single drive block bracket mounted to each of the needlebars adjacent their ends in communication with a shifting mechanism that applies transverse forces to laterally position the needlebar;

a yarn feed mounted along the tufting machine and feeding yarns to the needles; gauge parts positioned below the backing material, the gauge parts operable for seizing yarns from the needles penetrating the backing.

8. The tufting machine of claim 7 wherein the pushrods have a cylindrical bore extending from an upper end to a position proximate an opposite lower end, leaving a wall thickness of the cylindrical bore portion of no more than about 0.09375 inches.

9. The tufting machine of claim 7 wherein the front and rear needlebars are fabricated from titanium with titanium material removed in longitudinally milled pocket shapes on each side, while leaving a central web to provide rigidity.

10. The tufting machine of claim 7 each of the plurality of push rods has an upper end and an opposite lower end with said lower end connected to a foot piece.

11. The tufting machine of claim 10 wherein the foot pieces are disposed intermediately on stub shafts that have first and second ends received in linear bearings mounted in adjacent brackets connected to a needlebar.

12. The tufting machine of claim 11 wherein adjacent brackets receiving stub shafts disposed on either side of a foot piece are connected by a box link to provide rigidity.

13. The tufting machine of claim 7 wherein each of the front and rear needlebars carries a plurality of needle blocks of the type having a top surface, and intermediate body with a positioning post and positioning ledge, and a lower surface with protruding needles, the weight of the needle blocks being reduced by at least one of removing material from shoulders of the top surface, removing a portion of the positioning ledge, or creating more than one opening in the intermediate body by removing material not required for the strength of the needle block.

14. The tufting machine of claim 11 wherein the drive block bracket on the needlebar is connected by box links to adjacent brackets connected to the needlebar.

15. The tufting machine of claim 14 wherein a lateral actuator block extends upward from a drive block bracket base, said lateral actuator block being received in a cam roller bracket assembly extending downward from a transverse drive block that is laterally positioned by an underhead drive rod in communication with shifting mechanism.

16. The tufting machine of claim 11 wherein the foot pieces are disposed on four stub shafts.

17. The tufting machine of claim 16 wherein two of the four stub shafts are received in brackets connected to the front needlebar and two of the four stub shafts are received in brackets connected to the rear needlebar.

18. The tufting machine of claim 17 wherein the diameter of each of the two stub shafts received in brackets connected to the front needlebar is greater than 0.5 inches.

19. The lightweight needlebar drive system of claim 3 wherein each of the plurality of foot pieces is supported by first and second stub shafts, each with a first end and an opposite second end, the first and second ends of the first and second stub shafts extending from either side of the foot pieces being received in linear bearings mounted in adjacent brackets connected to the needlebar.

20. The lightweight needlebar drive system of claim 3 wherein only a single drive block bracket is mounted to the needlebar in communication with a shifting mechanism that provides transverse forces to laterally position the needlebar.

* * * * *